US006223391B1

(12) United States Patent
Kuo

(10) Patent No.: US 6,223,391 B1
(45) Date of Patent: May 1, 2001

(54) LOCKING ASSEMBLY OF A RETRACTABLE HANDLE FOR WHEELED LUGGAGE

(75) Inventor: Chung-Hsien Kuo, Pan-Chiao (TW)

(73) Assignee: Chaw Khong Technology Co., Ltd., Taipei County (TW)

( * ) Notice: Subject to any disclaimer, the term of this patent is extended or adjusted under 35 U.S.C. 154(b) by 0 days.

(21) Appl. No.: 09/359,039

(22) Filed: Jul. 23, 1999

(30) Foreign Application Priority Data

Jan. 15, 1999 (TW) ..... 88200681

(51) Int. Cl.[7] ..... A47B 95/02; A45C 13/22
(52) U.S. Cl. ..... 16/113.1; 190/115
(58) Field of Search ..... 16/113.1; 190/115; 280/655, 655.1, 47.371, 47.315

(56) References Cited

U.S. PATENT DOCUMENTS 5,374,073 * 12/1994 Hung-Hsin ..... 280/655 X
5,459,908 * 10/1995 Chen ..... 16/113.1
5,586,628 * 12/1996 Wang ..... 190/115
5,653,000 * 8/1997 Lee ..... 16/113.1
5,781,964 * 7/1998 Lin et al. ..... 16/113.1
5,876,048 * 3/1999 Lee ..... 280/47.315
5,951,037 * 9/1999 Hsieh et al. ..... 280/655

* cited by examiner

*Primary Examiner*—Robert J. Sandy
(74) *Attorney, Agent, or Firm*—Dougherty & Troxell

(57) ABSTRACT

A locking assembly of a retractable handle for wheeled luggage is disclosed. The locking assembly is accommodated between the sliding tube and the support tube. The U shaped locking assembly comprises an upper hollow standing part and a lower pedestal part. The standing part has a pair of projections provided on two opposite sides thereof for being correspondingly secured to the holes of the sliding tube when the sliding tube is inserted into the standing part. It is envisaged that the locking pin is eliminated while the engagement of the sliding tube and the support tube is enhanced as well as the handle operation is more smooth.

3 Claims, 5 Drawing Sheets

LOCKING ASSEMBLY OF A RETRACTABLE HANDLE FOR WHEELED LUGGAGE

BACKGROUND OF THE INVENTION

1. Field of the Invention

The present invention relates to a locking assembly of a retractable handle for wheeled luggage, and more particularly to an improvement of the locking assembly accommodated between the sliding tube and the support tube of a retractable handle for wheeled luggage.

2. Description of Related Art

Typically a convenient pull-handle is provided on a wheel luggage that can be easily pulled in the streets. Further, the pull-handle of most types of luggage is retractable for being stowed away when not in use and extended when needed.

A prior art retractable handle system is shown in FIG. 1. The handle system comprises a handle grip H, a pair of up-side-down L-like shaped members L, a bezel assembly P, a pair of sliding tubes A, a pair of locking assemblies B, a pair of sleeve members C, a pair of support tubes D, and a base E.

Referring to FIG. 2, there is shown an enlarged portion of the sliding tube A, the locking assembly B, the sleeve member C, and the support tube D on the right side of the prior art handle system of FIG. 1.

Referring to FIG. 1 again, a screw H2 is threaded through a hole H1 on an end portion of the handle grip H to an upper hole A1 of the sliding tube A for holding them together. The sliding tube A is inserted through the up-side-down L-like shaped member L and the bezel assembly P. Consequently, a locking pin B1 is inserted through a lower hole A2 of the sliding tube A and a hole B2 of the locking assembly B for holding them firmly. The sleeve member C is inserted into an upper portion D2 of the support tube D in which a pair of projections C3 (only one is shown) of the sleeve member C are clung to a corresponding pair of recessed portions D3 of the support tube D for providing the fit setting of the sleeve member C into the support tube D.

As to the operation, the locking assembly B is slidable within the support tube D. A lowest position of the locking assembly B is on a bottom of the sleeve member C. A spring B3 and a ball B4 are provided to be engaged with an upper hole D4 and a lower hole D5 in order to lock the locking assembly B in the hole D4 or D5.

In terms of the engagement of the sliding tube A and the support tube D, it is frequently designed that the locking pin B1 is inserted through the sliding tube A and the locking assembly B for being engaged against the support tube D. However, such a pin connection is slackened after a frequent and/or long time use. Accordingly, the operation of the retractable handle is not sufficiently smooth. Further, the diameters of the locking pin B1 and the lower hole A2 should be well matched. Otherwise, it is difficult to assemble them if the tolerance between the locking pin B1 and the hole A2 is relatively large. As a result, an additional cost will be spent on the manufacturing process in order to remedy them. Even worse, the quality of the retractable handle is poor.

Thus, it is desirable to provide an improved locking assembly of a retractable handle for wheeled luggage to overcome the above drawbacks of prior art.

SUMMARY OF THE INVENTION

It is an object of the present invention to provide a locking assembly of a retractable handle for wheeled luggage wherein the U shaped locking assembly comprises an upper hollow standing part and a lower pedestal part. The standing part has a pair of projections provided on two opposite sides thereof for being correspondingly secured to the holes of the sliding tube when the sliding tube is inserted into the standing part. It is envisaged that the locking pin is eliminated in order to obtain advantages such as simplifying the structure of the handle system, facilitating assembly, reducing the cost, and improving the handle quality.

The above and other objects, features and advantages of the present invention will become apparent from the following detailed description taken with the accompanying drawings.

DETAILED DESCRIPTION OF THE INVENTION

Figure 1:
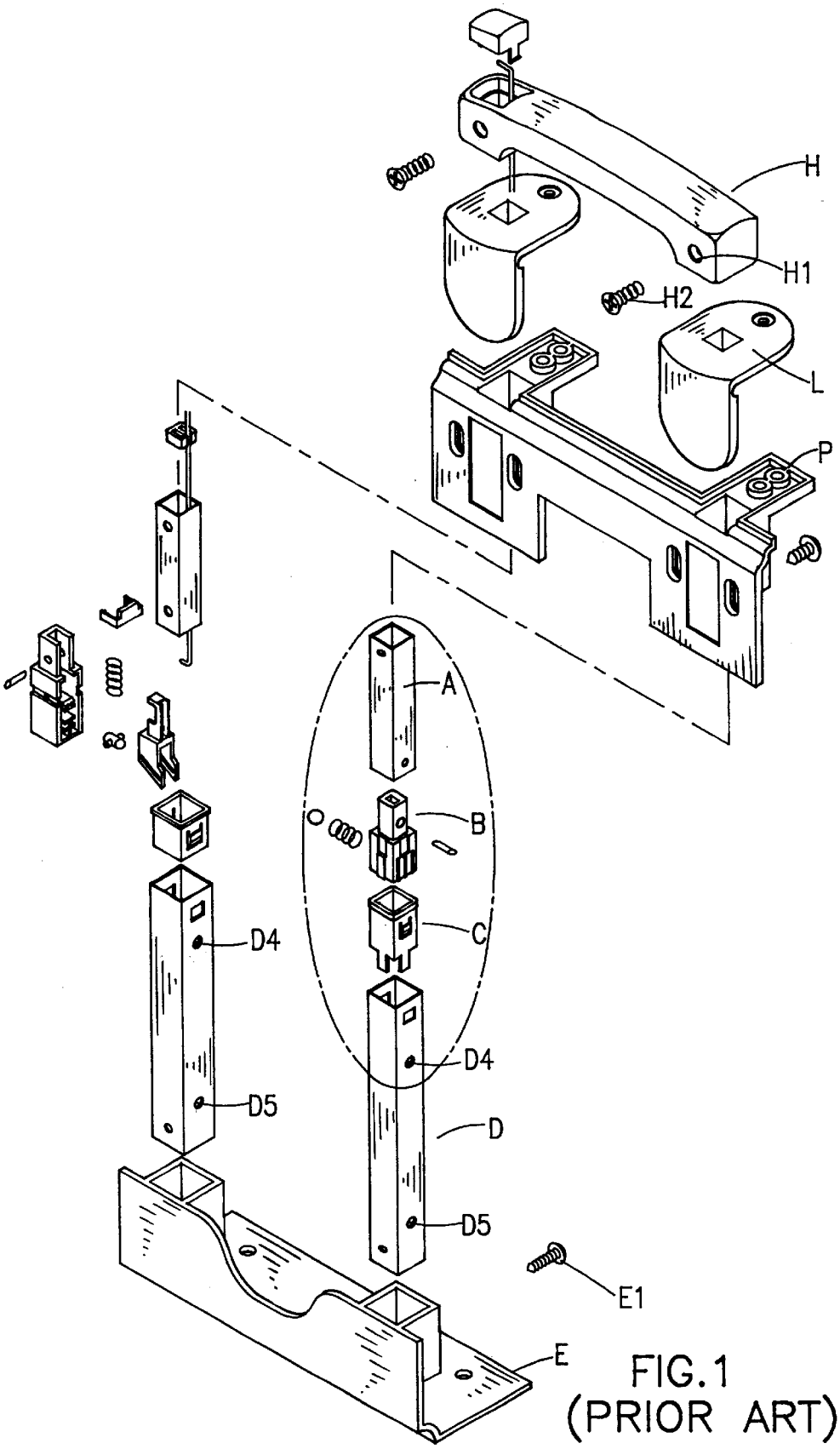
FIG. 1 (PRIOR ART)
FIG. 1 is an exploded perspective view of a prior art retractable handle for wheeled luggage.
Figure 2:
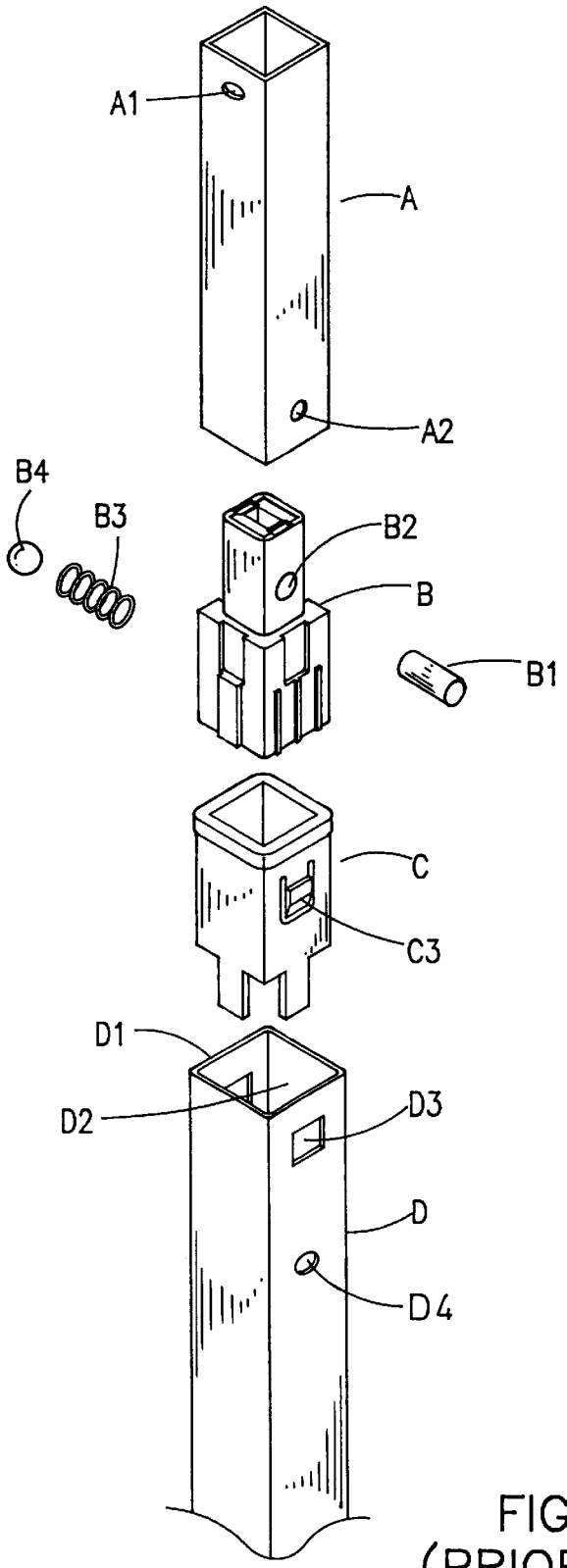
FIG.2 (PRIOR ART)
FIG. 2 shows an enlarged portion of the sliding tube, the locking assembly, the sleeve member, and the support tube on the right side of FIG. 1.
Figure 3:
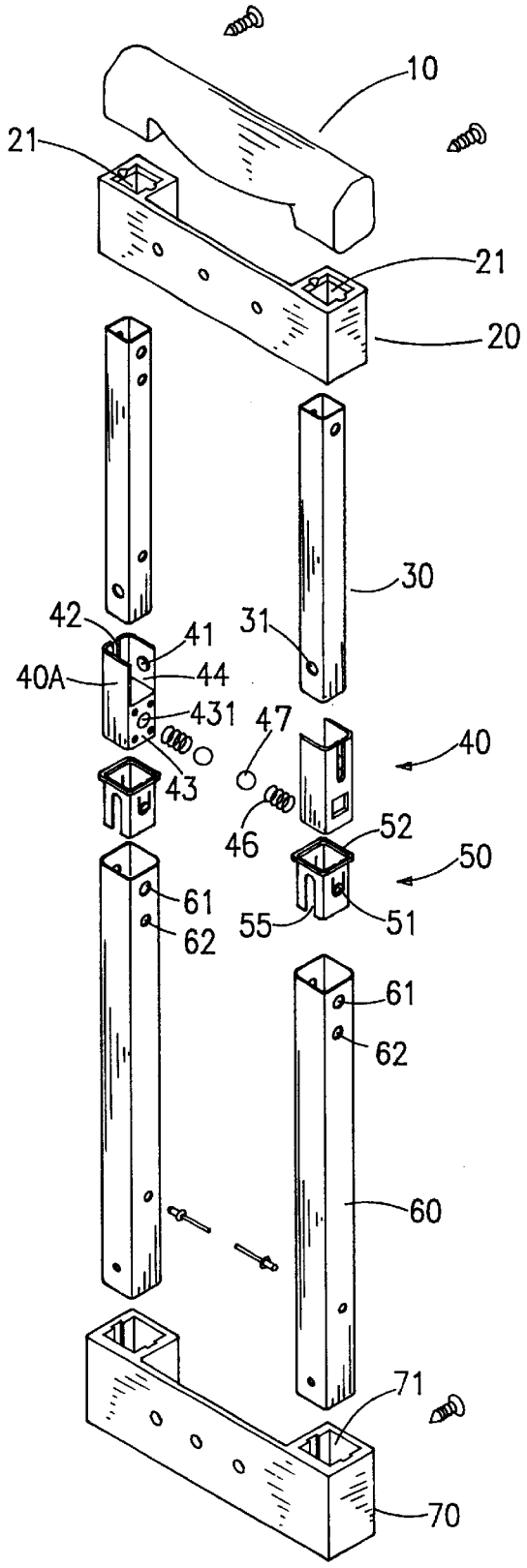
FIG. 3 is an exploded perspective view of the present invention.

Referring to FIG. 3, there is shown a handle system of the present invention. The handle system comprises a handle grip 10; a bezel assembly 20 provided on the top of the luggage (not shown) having a pair of through holes 21 each on an end portion thereof; a pair of sliding tubes 30 of generally rectangular cross-section in which the upper ends thereof are secured to the end portions of the handle grip 10; a pair of locking assemblies 40; a pair of sleeve members 50 of generally rectangular cross-section; a pair of support tubes 60 of generally rectangular cross-section for receiving the sliding tubes 30 therein, the support tubes 60 have a plurality of spaced retaining slots provided thereon for being in selective engagement with the sliding tubes 30; and a base 70 adapted to receive and secure the lower ends of the support tubes 60 therein. The detailed description thereof will be omitted herein because It is not critical to the present invention.

Figure 4:
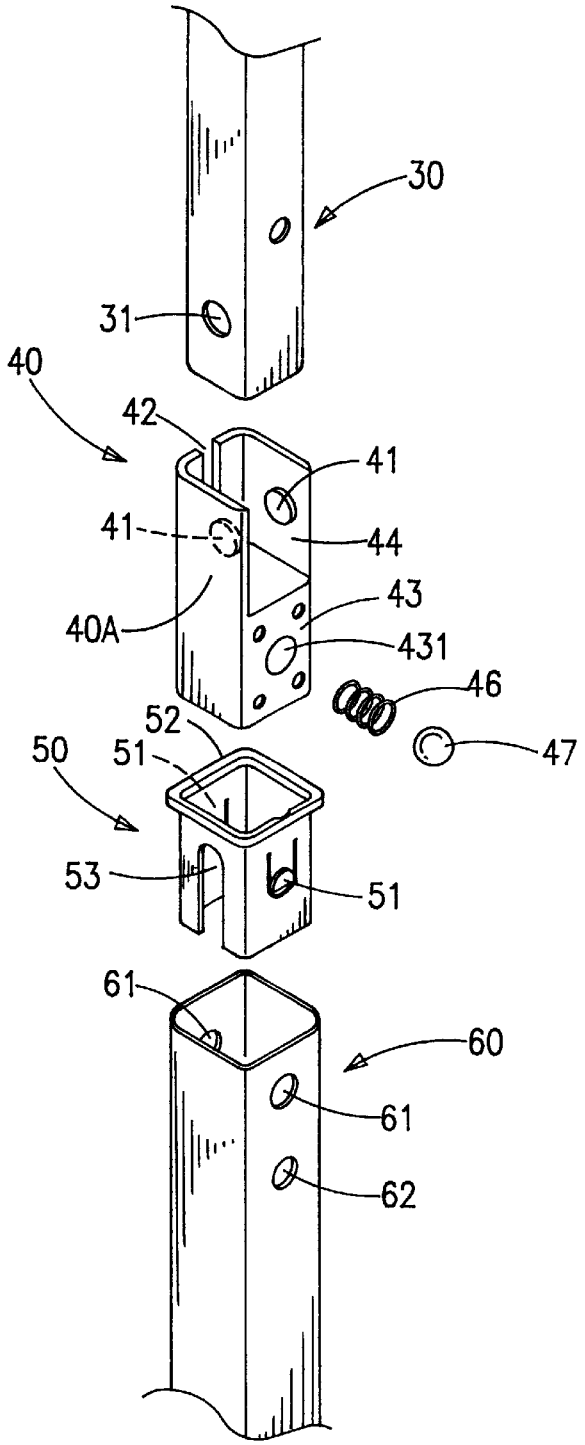
FIG. 4 shows an enlarged portion of the sliding tube, the locking assembly, the sleeve member, and the support tube on the right side of FIG. 3.
Figure 5:
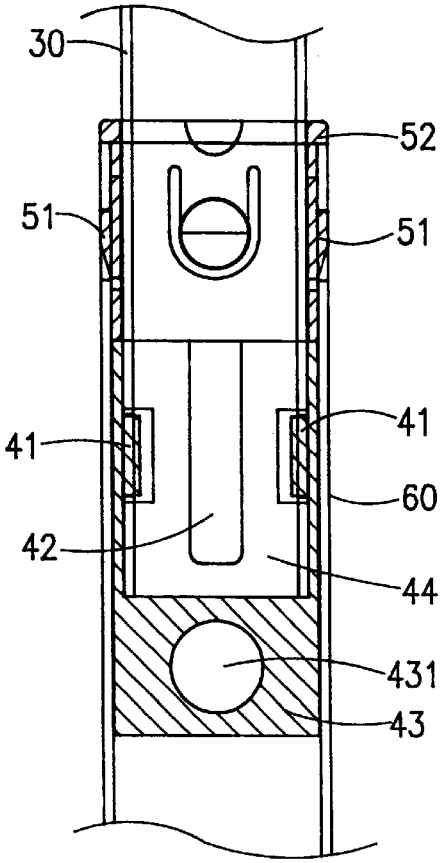
FIG. 5 is a cross-sectional view of the engagement of the sliding tube, the locking assembly, the sleeve member, and the support tube on the present invention.
Figure 6:
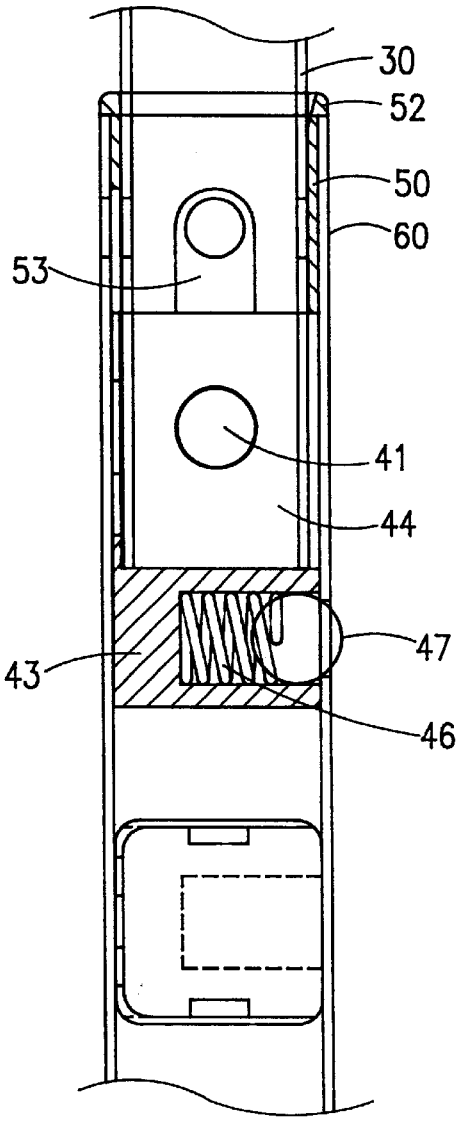
FIG. 6 is another cross-sectional view of the engagement of the sliding tube, the locking assembly, the sleeve member, and the support tube on the present invention.

Attention is invited now to FIG. 4 because the characteristic of the present invention is illustrated therein. The sliding tube 30 has a pair of lower holes 31. The sleeve member 50 comprises a circumferential flange 52 on the top, the circumference of the circumferential flange 52 is corresponding to that of the support tube 60; a pair of projections 51 on opposite sides; and a recessed portion 53 on a side other than the sides provided with projections 51 for providing flexibility. The support tube 60 has two upper holes 61 each corresponding to the projection 51, and a lower hole 62. The locking assembly 40 of generally U-like shape comprises an upper hollow standing part 40A having a space 44 therein for receiving the lower portion of the sliding tube 30, and a lower pedestal part 43 having a recessed portion 431 for receiving a spring 46 and a ball 47 which is urged against the spring 46. It is noted that the diameter of the ball 47 is slightly larger than that of the hole 62 for being locked within the space enclosed by the recessed portion 431 and the support tube 60. A pair of projections 41, provided on opposite sides of the standing part 40A inside, each corresponds to the lower hole 31 of the sliding tube 30. A recessed portion 42 is provided on a side of the standing part 40A other that the sides provided with the projections 41 for providing flexibility. It is noted that the locking assembly 40 and the sleeve member 50 both are made of plastic material such that a slight flexibility is possible when they are engaged with other parts.

The assembly of the present invention is shown and illustrated in FIGS. 3–6. First, the sliding tubes 30 are inserted through the hole 21 of the bezel assembly 20 to be secured to the end portions of the handle grip 10. Second, the lower ends of the support tubes 60 are received in the support sockets 71 of the base 70 for being secured therein. Third, the sleeve members 50 are inserted from the bottoms of the sliding tubes 30 to be disposed in a distance from the bottoms of the sliding tubes 30 temporarily. Fourth, the bottoms of the sliding tubes 30 are inserted into the locking assemblies 40 in which the holes 31 of the sliding tubes 30 are clung to the projections 41 of the locking assemblies 40 for providing the fit setting of the sliding tubes 30 onto the locking assemblies 40. Fifth, the springs 46 and the balls 47 are mounted into the recessed portions 431 of the pedestal parts 43 sequentially. Sixth, the locking assemblies 40 are inserted into the support tubes 60. Seventh, lower the sleeve members 50 for being inserted into the top portion of the support tubes 60. Eighth, the projections 51 of the sleeve members 50 are dung into the holes 61 of the support tubes 60. Finally, lock the balls 47 (which urged against the springs 46) in the lower holes 62 of the support tubes 60 as in the locked position of the sliding tubes 30.

As stated above, a plurality of spaced retaining holes (only two holes 61 and 62 are shown on a side of the support tube 60 in FIG. 4) are disposed on the support tube 60, whereby a selective engagement between the ball 47 and the support tube 60 is possible. It is only required to apply a slight force to pull or push the sliding tubes 30 for disengaging the balls 47 from the holes 62 in order to extend or retract the handle.

While the invention herein disclosed has been described by means of specific embodiments, numerous modifications and variations could be made thereto by those skilled in the art without departing from the scope of the invention set forth in the claims.

What is claimed is:

1. A retractable handle assembly for wheeled luggage, the handle assembly including a handle grip, a base and two hollow support tubes extending from the base, and comprising:

a) a sliding tube telescopically received in each of the two hollow support tubes, each sliding tube having a first end affixed to the handle grip, and a second end received in the associated hollow support tube, each of the second ends having a pair of lower holes therethrough; and, b) a locking assembly affixed to the second end of each sliding tube and located within the associated hollow support tube, each locking assembly having a lower pedestal with a spring and detent ball mounted therein, a flexible U-shaped standing portion extending from the lower pedestal and configured so as to receive the second end of the sliding tube within the U-shape standing portion, and two projections facing towards each other on the standing portion, whereby insertion of the second end of the sliding tube into the U-shape causes flexing of the standing portion enabling the projections to engage the pair of lower holes, thereby attaching the locking assembly to the sliding tube.

2. The retractable handle assembly for wheeled luggage of claim 1, wherein a recessed portion is provided on the pedestal of each locking assembly for receiving a spring and a ball therein.

3. The retractable handle assembly for wheeled luggage of claim 1, wherein a recessed portion is provided on a side of the standing portion other than sides of the standing part provided with projections.

* * * * *